US005727336A

United States Patent [19]

Ogden

[11] Patent Number: 5,727,336

[45] **Date of Patent: *Mar. 17, 1998**

[54] FOOTWEAR INSOLE WITH A MOISTURE ABSORBENT INNER LAYER

[75] Inventor: John M. Ogden, Cincinnati, Ohio

[73] Assignee: Ogden, Inc., Cincinnati, Ohio

[ * ] Notice: The portion of the term of this patent subsequent to Dec. 18, 2015, has been disclaimed.

[21] Appl. No.: 672,388

[22] Filed: May 28, 1996

Related U.S. Application Data

[63] Continuation of Ser. No. 350,199, Dec. 5, 1994, abandoned, which is a continuation-in-part of Ser. No. 828,426, Jan. 31, 1992, Pat. No. 5,388,349.

[51] Int. Cl.[6] ..... A43B 13/38; B32B 3/10

[52] U.S. Cl. ..... 36/43; 36/44

[58] Field of Search ..... 36/19.5, 43, 44, 36/114, 71, 3 R, 3 B

[56] References Cited

U.S. PATENT DOCUMENTS

| | | | |
|---|---|---|---|
| 3,735,511 | 5/1973 | Gilbert et al. | 36/44 |
| 3,853,665 | 12/1974 | Gardziella | 36/19.5 |
| 4,043,058 | 8/1977 | Hollister et al. | 36/28 |
| 4,186,499 | 2/1980 | Massock, Jr. et al. | 36/44 |
| 4,192,086 | 3/1980 | Sichak | 36/44 |
| 4,223,458 | 9/1980 | Kihara | 36/44 |
| 4,359,783 | 11/1982 | Andrews . | |
| 4,461,099 | 7/1984 | Bailly | 36/44 |
| 4,464,850 | 8/1984 | Ebert et al. | 36/44 |
| 4,524,529 | 6/1985 | Schaefer | 36/44 |
| 4,533,351 | 8/1985 | Washkuhn | 36/140 |
| 4,569,707 | 2/1986 | Johnson | 36/98 |
| 4,602,442 | 7/1986 | Revill et al. | 36/43 |
| 4,729,179 | 3/1988 | Quist, Jr. | 36/44 |
| 4,823,483 | 4/1989 | Chapnick | 36/44 X |
| 4,845,862 | 7/1989 | Phillips, Jr. et al. | 36/83 |
| 4,864,740 | 9/1989 | Oakley | 36/44 |
| 4,893,418 | 1/1990 | Ogden | 36/44 |
| 4,925,724 | 5/1990 | Ogden | 12/146 B |
| 5,036,603 | 8/1991 | Dischler | 36/44 |
| 5,350,625 | 9/1994 | Peterson et al. | 428/219 |
| 5,388,349 | 2/1995 | Ogden | 36/44 X |
| 5,433,987 | 7/1995 | Peterson et al. | 428/137 |

*Primary Examiner*—M. D. Patterson
*Attorney, Agent, or Firm*—Holland & Knight LLP

[57] ABSTRACT

An insole for an article of footwear which includes an apertured top layer formed of a non-absorbent, thermally non-conductive thermoplastic material, a non-woven layer having a first portion formed of a mixture of moisture-wicking and moisture-absorbent fibers affixed to the top layer, and, optionally, a second portion including fibers which are non-adsorbent and non-absorbent, and, in various embodiments, a barrier layer and/or cushioning layer(s) forming a laminate in which the non-woven layer is sandwiched between the top layer and such other layers. The chemical formulation of the top layer of thermoplastic material can be varied to alter its coefficient of friction or degree of slip resistance of the insole depending upon the requirements of a particular application.

25 Claims, 3 Drawing Sheets

FOOTWEAR INSOLE WITH A MOISTURE ABSORBENT INNER LAYER

This is a continuation of application(s) Ser. No. 08/350,199 filed on Dec. 5, 1994 now abandoned which is a continuation-in-part of U.S. Ser. No. 07/828,426, filed Jan. 31, 1992 (now U.S. Pat. No. 5,388,349).

FIELD OF THE INVENTION

This invention relates generally to insoles for articles of footwear, and, more particularly, to an insole comprising a laminate of a non-absorbent, thermally non-conductive top layer formed with apertures, and a moisture absorbent non-woven layer which can be affixed to at least one other layer such as a barrier layer and/or a cushioning layer.

BACKGROUND OF THE INVENTION

New designs of footwear, and particularly footwear intended for sports or other active wear, have provided improvements in the support, cushioning and stability in an effort to reduce injuries to the feet, ankles and knees. Nevertheless, certain aspects of active wear footwear design have been overlooked, including the construction and surface characteristics of the insole or sockliner of the article of footwear insofar as they relate to (1) the ability of the insole to maintain the foot and sock insulated from the sole of the footwear, (2) the ability of the insole to maintain the foot and sock drier, and (3) the extent which the foot and sock are permitted to move within the article of footwear.

One problem with many insoles for active wear footwear involves a failure to control the motion of the sock of the wearer relative to the insole and/or the motion of the foot of the wearer with respect to the sock. This affects both the comfort and performance of the shoe. For example, certain activities such as the play of tennis on clay courts and soccer on grass result in substantial movement of the shoe with respect to the playing surface. In these types of activities, it is desirable to limit the movement of the foot and sock with respect to the insole of the article of footwear for added comfort and to optimize the performance of the footwear. On the other hand, comfort and performance of the article of footwear dictate that the foot and sock be permitted more movement within footwear intended for use in activities such as basketball, racquetball and aerobics which are typically played on a lacquered hardwood floor wherein limited movement of the article of footwear relative to the playing surface is permitted and therefore relatively high shear forces are transmitted from the footwear to the foot.

Insoles can generally be divided into two categories, both of which fail to take into account the movement of the foot and/or sock within the article of footwear and the type of surface on which the footwear is utilized. In some designs, the top surface of the insole is formed of a tacky or sticky material, or a material which becomes relatively tacky when exposed to moisture from the foot. Insoles of this type exhibit a higher coefficient of friction than the coefficient of friction of the skin of the foot. As a result, the magnitude of the frictional engagement between the sock and insole is greater than the magnitude of the frictional engagement between the foot and sock. Articles of footwear provided with this type of insole have been found to create blisters on the foot during use because the foot is allowed to move within the sock in response to the application of a shear force, i.e., a front-to-rear, a side-to-side and/or rotational foot motion, while the sock is held in an essentially fixed position atop the insole. The rubbing motion of the foot within the sock can create severe blistering and discomfort, particularly in activities such as basketball and the like played on hardwood floors which permit limited motion of the shoe therealong.

Another general category of insole designs comprises a rubber or foam bottom layer which is covered by an overlayer of cloth or leather having a relatively slippery or slick surface with a much lower coefficient of friction compared to that of the skin. Insoles of this type help avoid the blistering problem because the foot and sock can move as a unit relative to the slippery top layer of the insole, instead of the foot moving within the sock. But the problem with these insoles is that movement of the sock and foot of the wearer is often completely unrestricted, and the toes are permitted to violently slide into the toe portion of the article of footwear causing bruising or even fractures. In addition, undue movement of the foot and sock gives the wearer a feeling of lack of control of the footwear, particularly in activities where the footwear readily slides along the playing surface.

These problems have been addressed in U.S. Pat. No. 4,893,418, owned by the assignee of this invention. The insole disclosed in such patent comprises a bottom layer formed of a cushioning material such as rubber or foamed plastic having an upper surface, and a lower surface adapted to overlie the sole of an article of footwear such as a shoe. The insole also includes a top layer formed of a non-absorbent, thermally non-conductive, thermoplastic material having a plurality of apertures which define intersecting columns and rows of thermoplastic strands or wall sections. The top layer is at least partially embedded in the bottom, cushioning layer so that a portion of the top layer extends beneath the upper surface of the bottom layer and at least partially enters the apertures in the top layer.

One advantage of the insole of Pat. No. 4,893,418 is that the frictional characteristics of the upper surface of the top layer are variable to control the movement of the foot and sock with respect to the insole, depending upon the type of activity and playing surface for which a particular article of footwear is designed. For example, in order to reduce or prevent blistering of the foot, the coefficient of friction of the apertured top layer can be chosen such that the magnitude of the frictional engagement between the sock and such top layer is less than the magnitude of the frictional engagement between the foot and sock during a given activity, while providing at least some resistance to movement of the sock and foot therealong. As a result, the foot and sock move together in a controlled manner with respect to the top layer of the insole in response to the application of a shear force to the foot instead of the foot sliding within the sock. Because the foot does not move with respect to the sock, the foot is substantially protected from the development of blisters and other problems created by sliding motion within an article of footwear.

While the sockliner or insole disclosed in U.S. Pat. No. 4,893,418 provides a number of advantages over other insoles, it has been found that some potential problems can arise with the use of such insole in articles of footwear, particularly those intended for certain types of vigorous activities such as basketball, racquetball, etc. As mentioned above, the apertures in the top layer of the insole form a matrix of interconnected wall sections, such as squares, rectangles, hexagons or the like. These wall sections are on the order of about 0.6 millimeters in thickness and about 0.5 millimeters in width. The thermoplastic material utilized to form this relatively thin apertured top layer exhibits good strength in compression, but is comparatively weak in shear.

As a result, front-to-back, side-to-side and/or rotational motion of the sock along the apertured top layer has a tendency to stretch, pull or otherwise move the wall sections of the top layer relative to one another. The resilient cushioning material within which the apertured top layer is embedded offers substantially no resistance to the application of such shear forces and thus readily permits such relative motion of the wall sections. The apertured top layer is therefore subject to tearing or ripping of its wall sections, and the cushioning material beneath can become worn and break down as the apertured top layer moves therealong.

Another potential limitation of the insole disclosed in U.S. Pat. No. 4,893,418 is that moisture from the foot and sock can collect along the apertured top layer because little or ineffective wicking and/or absorption of such moisture takes place within the cushioning layer beneath. Although some types of open cell foam materials can be utilized to form the cushioning layer affixed to the apertured top layer, such foam materials provide only a limited degree of moisture absorption and little or no wicking or channeling away of moisture from the top layer. Other types of foam materials, such as closed cell foams, provide essentially no absorption or wicking capability whatsoever.

A still further potential problem in the use of the insole disclosed in U.S. Pat. No. 4,893,418 in certain types of applications is that the apertured top layer can become delaminated from the cushioning layer. As disclosed in such patent, the apertured top layer and cushioning layer are interconnected by introducing the top layer onto the cushioning layer when it is in a "foamed" state, i.e., wherein the material has the consistency of whipped cream or the like before it is cured to a solid sheet. Alternatively, the apertured top layer can be molded to cushioning materials such as polyurethane which is liquid when initially combined with the top layer and thereafter cures to form a solid layer. In either case, the only connection between the apertured top layer and cushioning layer is the extent of surface contact between the cushioning material and the bottom and sides of the wall sections of the apertured top layer. This is a relatively small surface area. Additionally, the wall sections are made relatively smooth to provide comfort when contacted by the foot or sock of the wearer, which further increases the difficulty of obtaining a secure bond between the top layer and cushioning layer sufficient to avoid delamination.

SUMMARY OF THE INVENTION

It is therefore among the objectives of this invention to provide an insole for active wear footwear which provides a thermal barrier between the foot and sole of the footwear, which controls the movement of the foot and sock within the interior of the article of footwear, which is moisture absorbent, and which is resistant to wear, particularly under the application of shear forces.

These objectives are accomplished in an insole comprising an apertured top layer formed from a non-absorbent, thermally nonconductive thermoplastic material which is affixed to a non-woven layer formed of a mixture of moisture-wicking and moisture-absorbent fibers, or, alternatively, a non-woven layer including a first portion having moisture-wicking and moisture-absorbent fibers and a second portion having non-adsorbent, non-absorbent fibers. In alternative embodiments, the non-woven layer, in turn, is affixed to a barrier layer and/or a cushioning layer to form insoles for different types of articles of footwear intended for different activities.

One aspect of this invention is predicated upon the concept of controlling the motion of the foot and sock within the interior of an article of footwear with an insole which is highly resistant to wear and delamination. The non-absorbent, thermally non-conductive thermoplastic material which forms the top layer of the insole herein includes a plurality of spaced apertures defining strands or wall sections in the top layer between the apertures. These wall sections, preferably in the shape of interconnected squares, rectangles, hexagons, octagons or the like, are relatively small, i.e., on the order of about 0.6 mm in height and 0.5 mm in width. While such wall sections are strong in compression, the application of a shear force to the top layer induces the wall sections to stretch and move relative to one another which can cause tearing in the absence of constraint. One purpose of the non-woven layer of material herein is to provide dimensional stability of the apertured top layer so that its wall sections can resist relative movement under the application of shear forces. The apertured top layer is preferably heat-bonded or otherwise permanently affixed along its entire surface area to the non-woven layer such that the wall sections of the apertured top layer are substantially constrained from movement relative to one another under the application of a shear force. This greatly enhances the dimensional integrity and durability of the apertured top layer, particularly when the insole is incorporated in articles of footwear intended for active sports wherein the front-to-back, side-to-side and rotational motion of the foot can be severe.

Another purpose of the non-woven layer is to remove moisture from the area of the apertured top layer so that the foot and sock in contact with the apertured top layer remain substantially dry. In one presently preferred embodiment, the non-woven layer is formed of a mixture of adsorbent moisture-wicking fibers and moisture absorbent fibers, at least some of which are heat-bonded to the thermoplastic material forming the apertured top layer. The moisture-wicking fibers are effective to wick or transmit moisture away from the apertured top layer to the moisture-absorbent fibers which absorb the moisture. This moisture-absorbent feature of the non-woven layer assists in maintaining the foot and sock of the wearer dry, thus greatly enhancing comfort and the performance of the footwear.

In addition to the moisture-absorbency, dimensional stability and durability provided by affixing the non-woven layer to the apertured top layer, the stabilizing layer also contributes to the structural integrity of multi-layer insoles made in accordance with the teachings of this invention. In alternative embodiments herein, the surface of the non-woven layer opposite the apertured top layer is affixed to a cushioning layer such as crosslinked polyethylene, latex foam, polyurethane foam or other cushioning materials. It has been found that the moisture-wicking and moisture-absorbing fibers forming the non-woven layer create an extremely effective bond with cushioning material of the type mentioned above. It is believed that the fibers of the non-woven material become at least partially entangled or intertwined with the cushioning material thus providing a comparatively large surface area of contact therebetween so that an extremely secure bond is formed between the non-woven material and the cushioning layer. As a result, an insole formed by the laminate of an apertured top layer, a non-woven layer and a cushioning layer is securely held together and there is little change of delamination of any one of the three layers from the others.

In another aspect of this invention, it is recognized that different types of materials are preferable to others in forming the cushioning layer of the insole herein depending upon the particular type of activity for which an article of footwear is intended and the preferences of the wearer. One type of material commonly in use in the formation of insoles is polyurethane. In the formation of contoured insoles for athletic shoes, for example, polyurethane in liquid form is introduced into either an "open" mold, which is analogous to a waffle iron, or a closed mold which is analogous to an injection mold. In order to affix the laminate of the apertured top layer and non-woven stabilizing layer to the polyurethane, such laminate must be introduced into the mold with the liquid polyurethane. It has been found that in the course of closing the mold halves of the open mold, or in introducing the liquid polyurethane into the closed mold, sufficient pressure is developed to force the liquid polyurethane through the non-woven layer and through the apertures in the apertured top layer. This produces a "bleed-through" problem wherein at least a portion of the polyurethane is located atop the apertured top layer in the form of beads after the polyurethane has cured.

In another type of insole fabricated in accordance with this invention, liquid polyurethane is deposited onto a conveyor belt and the combined apertured top layer and non-woven layer is then laminated thereto. This produces a three-layer sheet material having an apertured top layer, a bottom layer of polyurethane and a non-woven layer sandwiched therebetween. It has been found that since the non-woven layer contacts the polyurethane while it is in a liquid state, the polyurethane can be absorbed by the moisture-absorbent fibers within the non-woven layer. Once the polyurethane cures, the overall moisture-absorbency of the non-woven layer is reduced due to the presence of the absorbed polyurethane.

In order to avoid bleed-through of polyurethane, and to prevent a loss of moisture absorbency, an alternative type of non-woven material is employed in fabricating the insoles of this invention as briefly noted above. In this embodiment, a "two-sided" non-woven material is used to form the non-woven layer, one side of which is affixed to the apertured top layer and the other side of which is affixed to a "barrier layer" or directly to a cushioning layer. This barrier layer is preferably a thin layer of acrylic latex, polyethylene, ethylene-vinyl acetate copolymer, vinyl or similar materials which are substantially liquid impervious. The "two-sided" non-woven material consists of a fabric layer having a first portion formed of a mixture of moisture-wicking fibers and moisture-absorbent fibers, connected to a second portion containing fibers which are non-adsorbent and non-absorbent. Preferably, the first portion of the non-woven layer includes a mixture of acrylic fibers and synthetic or natural cellulosic fibers, whereas the second portion is formed of polyester fibers.

In one embodiment of the insole herein employing the above-described two-sided non-woven material, the first portion of the non-woven layer is heat-bonded to the apertured top layer, and the second portion of the non-woven layer is affixed to the barrier layer. The non-adsorbent and non-absorbent polyester fibers forming the second portion of the non-woven layer are effective to prevent the barrier layer from entering and being absorbed within the first portion of the non-woven layer. In turn, the barrier layer blocks the flow of the liquid polyurethane during a pressurized molding operation using either type of molding apparatus mentioned above, so that there is no bleed-through of the polyurethane into the non-woven layer or into the apertured top layer in the finished insole.

In an alternative embodiment of an insole employing the two-sided non-woven material, the barrier layer can be eliminated without sacrificing the moisture-absorbency of the finished material. In this embodiment, the second portion of the two-sided non-woven material is affixed to liquid polyurethane deposited onto the conveyor belt in the fabrication method noted above. The moisture absorbency of the non-woven material is retained because the non-adsorbent and nonabsorbent polyester fibers within the second portion of the non-woven layer are effective to block penetration of the liquid polyurethane into the moisture-absorbing first portion of the non-woven layer.

It is presently contemplated that such barrier layer may also be eliminated in other types of insoles made in accordance with this invention. For example, insoles having a cushioning layer of a latex foam or crosslinked polyethylene foam do not require a barrier layer since these materials have a more solid consistency when combined with the apertured top layer and non-woven layer, e.g., like whipping cream, and do not tend to "soak" or absorb into the non-woven material prior to curing. In these embodiments of the insole herein, the two-sided non-woven layer may be eliminated and replaced with the "one-sided" non-woven material, e.g., wherein the entire layer is formed of a mixture of moisture-wicking and moisture-absorbent fibers.

In any of the embodiments of the insole herein mentioned above, an important aspect of this invention is predicated upon the frictional characteristics of the apertured top layer of the insole. In the presently preferred embodiment, the apertured top layer is formed of an ethylene-vinyl acetate copolymer whose vinyl acetate content can be varied to vary the coefficient of friction of the material. Tests have shown that regardless of the vinyl acetate content and resulting coefficient of friction, the apertured top layer of this invention exhibits the same coefficient of friction wet or dry. This feature of the apertured top layer of the insoles herein provide substantial benefits in functionality which cannot be achieved with prior art insoles.

One advantage of the construction of the apertured top layer involves protection of the foot from blistering and other discomfort caused by movement of the foot with respect to the sock. The coefficient of friction of the apertured top layer herein is maintained such that the magnitude of the frictional engagement between the apertured top layer and sock is less than the magnitude of frictional engagement between the sock and foot. This is true whether or not the apertured top layer is wet or dry. The objective is to prevent movement of the foot with respect to the sock as the foot sweats and moistens the sock. By ensuring that the magnitude of the frictional engagement between the apertured top layer and sock is less than that between the sock and foot, the sock and foot are made to move as a unit along the insole while the foot is held substantially fixed with respect to the sock. Because the foot is thus prevented from sliding within the sock, the rubbing movement which can cause blisters is eliminated.

Additionally, control of the frictional characteristics of the top surface of an insole is important to the comfort, feel and functionality of such insole. For example, activities such as basketball, racquetball, squash, aerobic exercises and the like are typically played on surfaces such as lacquered hardwood floors which permit little or no movement of the outersole of an article of footwear with respect to such surfaces. The same is true of various types of artificial playing surfaces. Because of the relatively high coefficient of friction of such surfaces, and the design of the outersole of the articles of footwear intended for use on such surfaces, relatively high shear forces are applied by the article of footwear to the foot and sock while playing activities on such surfaces. On the other hand, many other types of activities do not result in the application of high shear forces to the foot, and considerations such as comfort, feel and control of the shoe are more important. For example, activities such as the play of tennis on clay courts or soccer on grass results in the shoe readily sliding with respect to the playing surface. Running, walking, hiking and similar activities also do not result in the application of comparatively high shear forces to the foot.

The insole of this invention can be fabricated to accommodate all of the activities mentioned above. In order to avoid the application of undue shear forces to the foot during activities played on high friction surfaces, the coefficient of friction of the apertured top layer of the sheet material herein is reduced to permit at least some sliding motion of the foot and sock along the apertured top layer in response to the application of shear forces. Insoles intended for activities which impose lower shear forces on the foot include an apertured top layer whose coefficient of friction is increased. This increases the magnitude of the frictional engagement between the insole and sock to provide an enhanced feeling of control of the article of footwear and improved comfort. But in either of these applications, the coefficient of friction of the apertured top layer of the sheet material is nevertheless controlled so as to ensure that the magnitude of the frictional engagement between the sock and apertured top layer of the sheet material is maintained less than the magnitude of the frictional engagement between the sock and foot during a particular activity. This prevents movement of the foot relative to the sock and thus protects the foot from blistering, as noted above.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
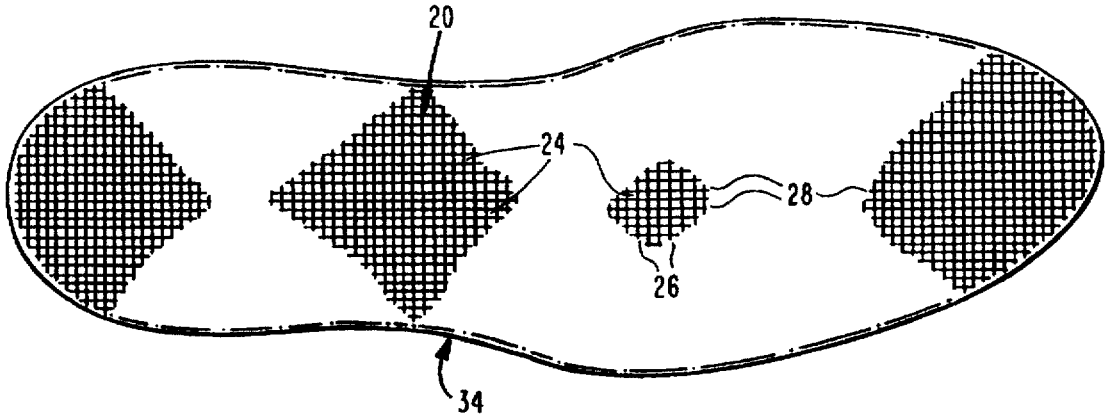
FIG. 1 is a plan view of one embodiment of the insole of this invention.
Figure 2:
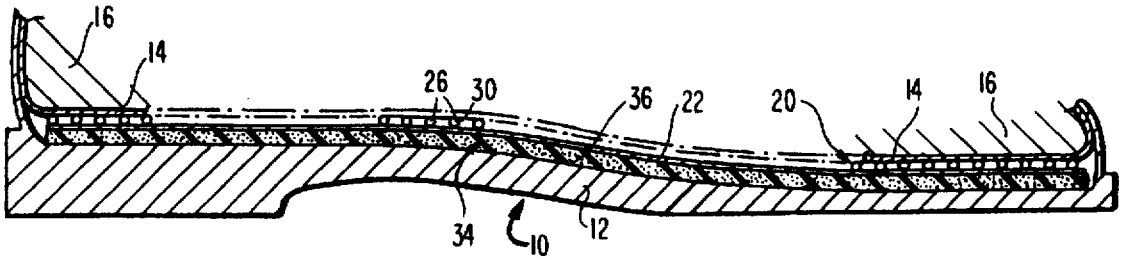
FIG. 2 is a partial cross sectional view of a shoe incorporating one embodiment of the insole of this invention.

Referring now to FIGS. 1 and 2, a schematic view of an article of footwear such as a shoe 10 is illustrated having a sole 12 and an insole 34, described in detail below in connection with a discussion of FIG. 5, which is positioned atop the sole 12. The insole 34 supports the sock 14 and foot 16 of the wearer. This invention is directed to various constructions of insoles for use in articles of footwear such as the shoe 10 which provides comfort and control of the shoe 10, and which protects the foot 16 from blistering and from violent collisions with the toe portion and uppers (not shown) of the shoe 10 which can damage the toes and other portions of the foot.

Figure 4:
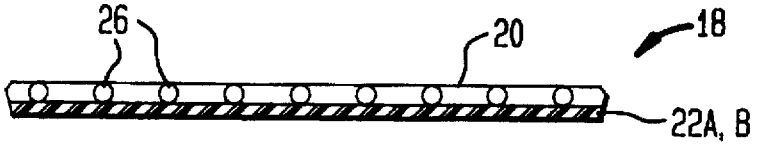
FIG. 4 is a cross sectional view of a portion of another embodiment of the insole herein.

With reference to FIG. 4, one embodiment of an insole 18 is illustrated which comprises an apertured top layer 20 affixed to a non-woven layer 22. As described in more detail below, each of the various embodiments of the insole of this invention employ the basic construction of insole 18, e.g., top layer 20 and non-woven layer 22, with the addition of various other layers depending upon the requirements of a particular application.

In the presently preferred embodiment, the apertured top layer 20 is formed of a non-absorbent, thermally non-conductive thermoplastic material such as an ethylene-vinyl acetate copolymer commercially available from U.S. Industrial Chemicals Company of Tuscola, Ill. under the registered trademark "ULTRATHENE." As discussed in more detail below, the vinyl acetate content of the ULTRATHENE thermoplastic material is variable to alter the coefficient of friction of the apertured top layer 20 as desired.

The ethylene-vinyl acetate copolymer is extruded in sheet form, in a configuration described below, which is then cut to form the top layer 20 of insole 18. In one presently preferred embodiment, a quantity of thermoplastic elastomer is added to the ethylene-vinyl acetate copolymer in an effective amount to prevent wrinkling of the sheet material after it is extruded. The thermoplastic elastomer content of the top layer 20 is preferably in the range of about 20% to 40% by weight, and more preferably about 25% by weight. One suitable type of thermoplastic elastomer is commercially available under the trade name KRATON D 3226 from Shell Oil Company of Oak Brook, Ill.

Figure 3:
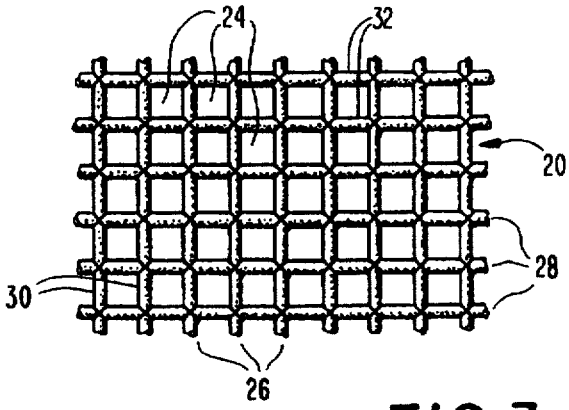
FIG. 3 is an enlarged plan view of the apertured top layer of the insole shown in FIGS. 1 and 2.

As best illustrated in FIGS. 1 and 3, the apertured top layer 20 is formed with a plurality of apertures 24 spaced at regular intervals from one another. These apertures 24 define spaced strands or wall sections 30 of thermoplastic material arranged in side-by-side columns 26, and spaced strands or wall sections 32 of thermoplastic material arranged in side-by-side rows 28.

In one presently preferred embodiment, the apertures 24 in the top layer 20 are substantially square in cross section, i.e., wherein the columns 26 and rows 28 of wall sections 30 and 32, respectively, intersect one another at right angles. It is contemplated, however, that the apertures 24 could be formed in other shapes such as rectangular, octagonal, hexagonal and others preferably having walls intersecting at an angle of 90° or greater. The dimensions of the apertures 24 are not critical, although it is preferable that they be in the range of about 7 to 107 apertures 24 per square centimeter of surface area of apertured top layer 20. With square apertures 24, this produces a "strand count" in the range of about 1 to 14 strands per lineal centimeter in both directions. It has been found that within this range, a strand count of about 8 to 9 strands per centimeter is acceptable in most insoles, i.e., the apertured top layer 20 has 8 to 9 columns 26 of wall sections 30 within one centimeter along a direction from right to left as viewed in FIG. 3, and 8 to 9 rows 28 of wall sections 32 along one centimeter in a direction from top to bottom as viewed in FIG. 3. This range of strand counts is not intended to be restrictive of the configuration of top layer 20, but it has been found that such configuration produces a top layer 20 which exhibits good performance properties.

The thickness or height of the wall sections 30 and 32 forming the apertured layer 20, i.e., their largest transverse dimension measured in a vertical plane as viewed in FIGS. 4–9, is preferably in the range of about 0.38 to 3.8 mm. More preferably, the thickness of such wall sections 30, 32 is about 0.6 mm. The width of the wall sections 30 and 32 measured in a horizontal plane as viewed in FIG. 3 is in the range of about 0.38 to 3.8 mm and preferably about 0.5 mm. It is contemplated that the height or thickness dimension, and the width dimension, of the wall sections 30 and 32 could be increased as desired for a particular application. The above ranges of dimensions of the wall sections 30 and 32 are therefore not intended to be restrictive. Additionally, in the embodiment of the insole 18 illustrated in FIG. 4, and in other embodiments discussed below, the wall sections 30 and 32 forming the apertured top layer 20 have a generally circular or at least arcuate-shaped cross section. It is contemplated however, that the cross section of the wall sections 30, 32 could be square or rectangular in shape depending upon the configuration of the extrusion equipment used to form apertured top layer 20.

Figure 8:
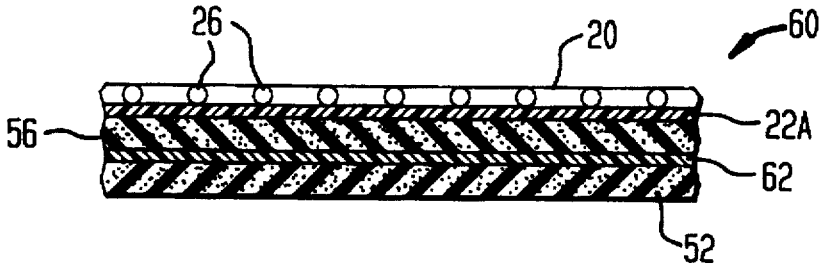
FIG. 8 is a cross-sectional view of an insole similar to that shown in FIG. 7, except with the position of the cushioning layers reversed.
Figure 9:
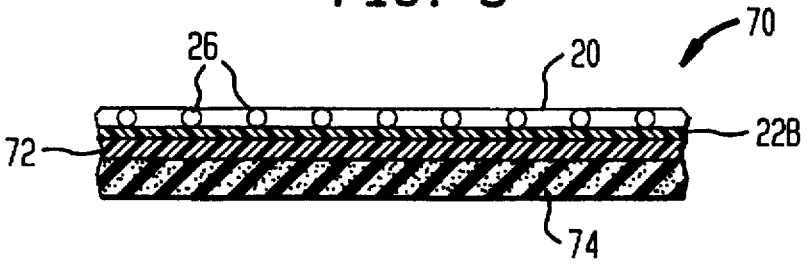
FIG. 9 is a cross sectional view of a portion of a still further embodiment of the insole of this invention.
Figure 10:
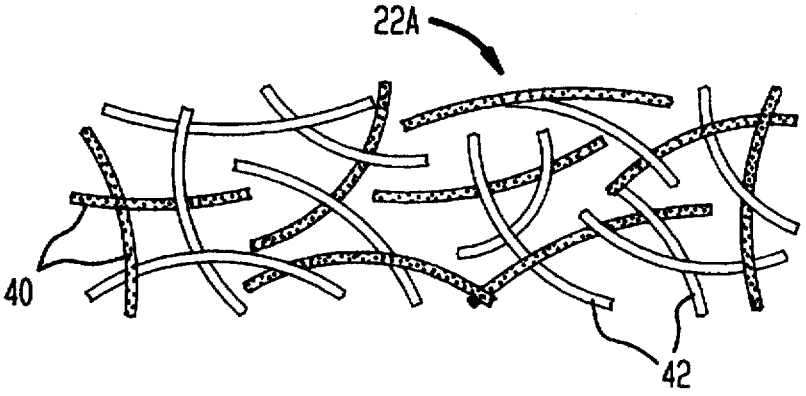
FIG. 10 is a schematic, enlarged cross sectional view of one form of the non-woven material employed in the insoles of this invention.
Figure 11:
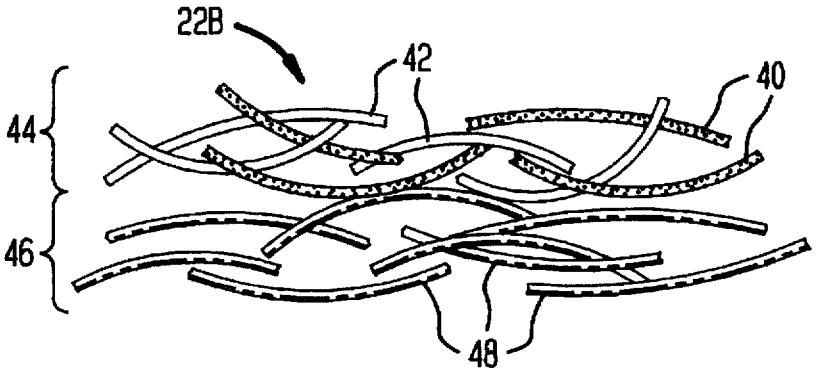
FIG. 11 is an enlarged cross sectional view of an alternative form of the non-woven material employed herein.

With reference to FIGS. 10 and 11, a schematic depiction of the non-woven layer 22 is provided which is formed in two configurations including a "one-sided" non-woven layer 22A (FIG. 8), and a "two-sided" non-woven layer 22B (FIG. 9). In the presently preferred embodiment, the term "one-sided" is meant to refer to a non-woven layer formed of a mixture of adsorbent, moisture-wicking fibers 40 such as acrylic fibers, and moisture-absorbent fibers 42 such as natural or synthetic cellulosic fibers. One type of non-woven material suitable for use as a one-sided non-woven layer 22A is commercially available from E. I. du Pont de Nemours and Company under the trademark COMFORSORB, and has the following specifications:

| | |
|---|---|
| fiber cross sections | round |
| fiber configuration | crimped |
| fiber length | 0.75–3.0 inches (1.9–7.6 cm) |
| denier per filament | 0.75 to 3.0 |
| tear strength | 34.7 pounds - machine direction<br>24.7 pounds - cross direction |
| basis weight | approximately 2 ounces per square yard |
| preferred fiber mixture | 25% to less than 50% moisture-wicking fibers; |
| most preferred fiber mixture | 30%–40% moisture-wicking fibers;<br>70%–60% moisture-absorbent fibers. |

In the presently preferred embodiment, the moisture-wicking fibers 40 are acrylic fibers which are adsorbent, i.e., these fibers effectively wick or induce the flow of moisture therealong but do not absorb moisture. Additionally, the acrylic fibers are preferably formed from a resin in which an anti-microbial substance is introduced such that the resulting acrylic fibers have anti-microbial, bacteriostatic and fungicidal properties and provide those functions upon contact with moisture and the like. One presently preferred anti-microbial substance which can be incorporated within the acrylic fibers 40 is commercially available from Phoenix Medical Technology, Inc. of Andrews, S.C., under the name "Microban." The moisture-absorbent fibers 42 are preferably synthetic, cellulosic fibers capable of absorbing moisture upon contact which is the removed therefrom via evaporation. It is contemplated that other types of cellulosic fibers could be employed such as wood pulp, etc.

The "two-sided" non-woven layer 22B schematically depicted in FIG. 11 preferably comprises a first portion 44 interconnected to a second portion 46. The first portion 44 is preferably formed of the same mixture of moisture-wicking fibers 40 and moisture-absorbent fibers 42 found in non-woven layer 22A. The second portion 46 is preferably formed of fibers 48 which are both non-adsorbent and non-absorbent, such as polyester fibers. That is, the second portion 46 of non-woven layer 22B neither absorbs liquid, such as moisture from the feet, nor readily wicks or transfers liquid therealong. As discussed in more detail below in connection with a description of different embodiments of the insoles herein, it is highly advantageous in certain applications to provide a non-woven fabric layer having the capability of moisture-absorbency on one side, and a resistance to penetration by liquid on the opposite side.

The specifications for one particular two-sided non-woven layer 22B suitable for use in this invention are as follows:

| | |
|---|---|
| fiber cross sections | round |
| fiber configuration | crimped |
| fiber length | 0.75–3.0 inches (1.9–7.6 cm) |
| denier per filament | 0.75 to 3.0 |
| tear strength | 97.5 pounds - machine direction<br>60.7 pounds - cross direction |
| basis weight | 4.4 ounces per square yard -<br>2.2 ounces first portion 44<br>2.2 ounces second portion 46 |
| preferred fiber mixture of first portion 44 | 25% to less than 50% moisture-wicking fibers;<br>75% to greater than 50% moisture-absorbent fibers |
| most preferred fiber mixture of first portion 44 | 30%–40% moisture-wicking fibers;<br>70%–60% moisture-absorbent fibers |
| preferred fiber mixture of second portion 46 | 100% polyester fiber |

In either embodiment of layers 22A and 22B, the non-woven material has a preferred basis weight in the range of about 2 to 5 ounces per square yard, a tear strength measured in the machine direction in the range of roughly about 35–100 pounds, and a tear strength measured in the cross direction in the range of roughly about 25–60 pounds.

An insole 18 fabricated with an apertured top layer 20 and non-woven layer 22 of the materials set forth above is cut in the general shape of a footprint, as depicted in FIG. 1, and adapted to overlie the sole 12 of a shoe 10 such that the non-woven layer 22 contacts the sole 12. In addition to moisture absorbency, the layer 22 provides dimensional stability to the apertured top layer 20. While the apertured top layer 20 formed of an ethylene-vinyl acetate copolymer exhibits good strength in compression, its wall sections 30 and 32 tend to deform, stretch or otherwise more relative to one another under the application of shear forces to the apertured top layer 20, i.e., forces directed in a horizontal plane such as those imposed by front-to-back, side-to-side and/or twisting motion of the sock 14 and foot 16 upon the insole 18 within the shoe 10. Because the non-woven layer 22 is heat laminated, or otherwise permanently affixed to the apertured top layer 20, the wall sections 30, 32 of top layer 20 are securely affixed along substantially their entire surface area to the non-woven layer 22. The non-woven material forming the non-woven layer 22 is comparatively strong in shear, e.g., preferably having a tear strength in the range of about 50 to 100 pounds depending upon its basis weight, and it is effective to stabilize the wall sections 30 and 32 of top layer 20 by substantially constraining their movement relative to one another in response to the application of shear forces to the apertured top layer 20. This substantially reduces tearing or other damage to the wall sections 30, 32 and thus increases the wear life of the apertured top layer 20.

Figure 5:
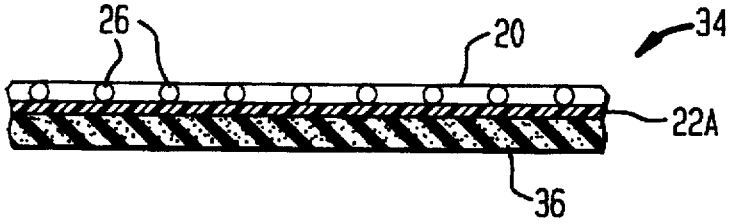
FIG. 5 is a cross sectional view of a portion of the embodiment of the insole herein also shown in FIG. 2.

An alternative embodiment of an insole 34 is illustrated in FIG. 5 which incorporates the apertured top layer 20 and non-woven layer 22 of insole 18, and further includes a cushioning layer 36. As depicted in FIG. 5, the cushioning layer 36 is affixed to the bottom of non-woven layer 22 thus forming a trilaminate in which the non-woven layer 22 is sandwiched between the apertured top layer 20 and the cushioning layer 36. The cushioning layer 36 is preferably formed of a resilient, cushioning material such as cross-linked polyethylene foam, latex foam, ethylene-vinyl acetate foam, ethylene-vinyl acetate enhanced cross-linked polyethylene foam, sponge rubber foam and vinyl sponge foam. These types of foam materials are available in sheet form and can be laminated to the non-woven layer 22 by heat bonding, adhesive or other suitable means. Because of this type of connection between cushioning layer 36 and non-woven layer 22, a one-sided, non-woven layer 22A is preferably employed in the manufacture of insole 34, e.g., one with moisture-wicking fibers 40 and moisture-absorbent fibers In addition to the properties exhibited by the laminate of the top layer 20 and non-woven layer 22 discussed above, the cushioning layer 36 provides the insole 34 with a resilient, cushioning feel when contacted by the foot 16. The cushioning layer 36 may be in the form of a flat sheet which can be adhered to or placed atop the sole 12 of shoe 10, or, in the case of athletic shoes, the cushioning layer 36 can be molded in a contoured shape to conform to the sole 12 and heel area of the shoe 10. See FIG. 2. The thickness of the cushioning layer 36 is variable depending upon the design of a particular article of footwear, the degree of cushioning feel desired and other factors.

Figure 6:
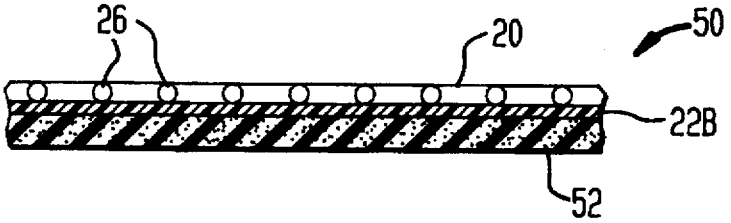
FIG. 6 is a cross-sectional view of an insole similar to FIG. 5, except with a different type of cushioning material.

An alternative embodiment of the insole 34 shown in FIG. 5 is depicted in FIG. 6, and given the reference number 50. The insole 50 has the same apertured top layer 20 as insole 34, but a two-sided non-woven layer 22B is employed because a different type of foam material is utilized to form a bottom cushioning layer 52 of insole 50. In the presently preferred embodiment, the bottom cushioning layer 52 is formed of a polyurethane foam material, which can be manufactured in sheet form, and is commercially available under the trademark KANGACUSHION from Textile Rubber & Chemical Company of Dalton, Ga. In order to affix the polyurethane foam to the non-woven layer 22B, the polyurethane material is deposited in liquid form onto a conveyor mechanism and then the second portion 46 of non-woven layer 22B is placed atop the urethane while it is still in liquid state so that at least some of the non-adsorbent and non-absorbent fibers 48 of the second portion 46 become intertwined with or surrounded by the liquid urethane. Thereafter, the urethane cures to form a solid sheet which is permanently affixed to the non-woven layer 22B.

The reason a two-sided non-woven layer 22B is preferred for the insole 50 of this embodiment is to avoid a loss of moisture-wicking and/or moisture-absorbency of the finished article. The non-adsorbent and non-absorbent second portion 46 of non-woven layer 22B substantially prevents entry of the liquid polyurethane within the absorbent, first portion 44 of non-woven layer 22B thus avoiding a loss of moisture absorbency in the finished insole 50. As such, the fibers 48 within the second portion 46 of non-woven layer 22B form a barrier to block the passage of liquid polyurethane into first portion 44.

Figure 7:
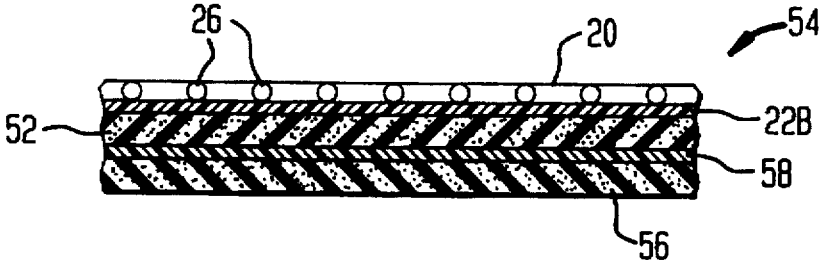
FIG. 7 is a cross sectional view of an insole incorporating the construction of FIG. 6 with the addition of a second cushioning layer.

Referring now to FIG. 7, a still further embodiment of an insole 54 according to this invention is shown in cross section. The insole 54 has the identical top layer 20, non-woven layer 22B and cushioning layer 52 of the insole 50 of FIG. 6, with the addition of a lowermost cushioning layer 56 at the bottom of insole 54. In the presently preferred embodiment, the second, lowermost cushioning layer 56 is formed of a heat-formable foam material such as cross-linked polyethylene and the like. The lowermost cushioning layer 56 is affixed to the cushioning layer 52, which, as noted above, is formed of a polyurethane foam, using a soft, low density and low melting point sheet material such as ethylene-vinyl acetate, urethane or similar material which is depicted as layer 58 in FIG. 7. The layer 58 is preferably flame laminated to the cushioning layer 56 where it essentially melts to form a surface which, in turn, adhesively bonds to the cushioning layer 52 when the two layers 52, 56 come into content with one another.

With a heat-formable cushioning layer 56 forming the bottom of insole 50, it can be molded in a contoured profile such as depicted in FIG. 2. The polyurethane foam forming layer 52 conforms to the shape of the cushioning layer 56 and provides an enhanced and long-lasting cushioning effect for the wearer's foot. Polyurethane and similar foam materials have "memory," i.e., they rebound and return to their original shape and thickness after undergoing a comprehensive force. Foams such as cross-linked polyethylene and ethylene vinyl acetate, on the other hand, tend to lose resiliency or an ability to return to their original thickness under the application of repeated compressive forces which reduces their cushioning ability within an insole. Nevertheless, one advantage of such foams is that they can be thermo-formed to essentially any desired contour and can closely conform to the steps of the bottom of the foot. This enhances the comfort of the insole, and provides cushioning material at "pressure points" along the bottom of the foot, e.g., at the ball of the foot and heel.

Consequently, the combination of cushioning layers 52 and 56 provide advantages which neither layer achieves alone. The polyurethane or similar material making up cushioning layer 52 adds resiliency and cushioning to insole 50 over an extended period of time and after repeated compressive loading of same. The cushioning layer 56 on the bottom of insole 50 is preferably formed to closely match the contour of the wearer's foot, and the cushioning layer 52 assumes the same shape during the molding operation. The resulting insole 50 is not only comfortable and resilient, but provides additional support along those areas of the feet which receive the most pressure upon contact with the ground or other surface, e.g., the ball and heel areas of the feet.

A still further alternative embodiment of an insole 60 is depicted in FIG. 8, which is essentially the reverse of insole 54 at the lower portion thereof. In insole 60, the same top layer 20 and non-woven layer 22A used in insole 50 are employed, but the position of cushioning layers 52 and 56 is reversed compared to the insole 54 of FIG. 7. That is, the cushioning layer 52 formed of urethane, polyurethane or the like forms the lowermost, bottom portion of the insole 60 of this embodiment, whereas the cushioning layer 56, made of cross-linked polyethylene or other heat-formable foam material is interposed between the non-woven layer 22 and cushioning layer 52.

The insole 60 of this embodiment is preferably fabricated in a pressurized, urethane molding machine in which liquid polyurethane or the like is introduced into male and female mold halves to form the finished insole 60 in the presence of heat and pressure. In order to achieve a good bond between cushioning layers 52, 56 with this insole-manufacturing technique, the cushioning layer 56 is affixed to an adhesive net material, preferably of the type sold by AET Applied Extrusion Technology of Middletown, Del. under the trademark "SHARNET." This adhesive net material, depicted by the layer 62 in FIG. 8, is preferably a polyester adhesive netting which is flame-laminated to the cushioning layer 56. With the adhesive netting layer 62 affixed to cushioning layer 56, the entire laminate of layers 20, 22, 56 and 62 is then placed between the male and female mold halves of a polyurethane molding machine. Liquid polyurethane is introduced into the mold, which, under the application of heat and pressure, forms the bottom cushioning layer 52. The cushioning layer 56 prevents the liquid polyurethane from passing therethrough and entering the non-woven layer 22 where it could be absorbed and reduce the moisture-wicking and moisture-absorbing capability of non-woven layer 22.

With reference to FIG. 9, a still further embodiment of an insole 70 according to this invention is illustrated. The insole 70 comprises the same apertured top layer 20 and non-woven layer 22 of insole 50 described above in connection with a discussion of FIG. 6, with the addition of a barrier layer 72 and a cushioning layer 74 forming the bottom of insole 70. In one presently preferred embodiment, the barrier layer 72 is affixed by adhesive or an other suitable means to the bottom of the non-woven layer 22 such that the non-woven layer 22 is sandwiched between the apertured top layer 20 and barrier layer 72. In this embodiment, the barrier layer 72 is of one of a variety of substantially moisture impervious materials such as acrylic latex, polyethylene, vinyl, ethylene-vinyl acetate copolymer and the like. Additionally, the barrier layer 72 preferably includes an anti-microbial material having bacteriostatic and fungistatic properties. One suitable antimicrobial material is commercially available under the trademark ULTRAFRESH DM50, distributed by Thomson Research Associates of Toronto, Canada.

In the presently preferred embodiment, the cushioning layer 74 is formed of polyurethane affixed to the bottom of the barrier layer 72, as shown, utilizing the same process described above in connection with a discussion of FIG. 8, i.e., the polyurethane is introduced in liquid form into an open mold or closed mold (not shown) where it is combined with the remaining layers of insole 70. Because the non-woven material forming the non-woven layer 22 is porous, and the top layer 20 is formed with apertures 24, the presence of the moisture impervious barrier layer 72 is necessary to prevent bleed-through or passage of the liquid polyurethane forming the cushioning layer 74 into the non-woven layer 22 and/or apertured top layer 20 during the molding operation. This is true whether the one-sided non-woven material 22A or the two-sided non-woven material 22B is employed. Even with the non-adsorbent fibers 48 of the second portion 46 of two-sided non-woven material 22B, the pressure developed within the molds in this type of insole-forming operation would cause the polyurethane to bleed through the non-woven layer 22 in the absence of the barrier layer 72. If the polyurethane was permitted to pass through the apertured top layer 20, and thereafter cure, beads or dots of polyurethane would form atop the finished insole 70 thus producing an unacceptable surface finish. Consequently, the barrier layer 72 performs an important function in protecting layers 20, 22 from any intrusion of polyurethane during the molding operation.

In each of the embodiments of the insoles depicted in FIG. 4–9, an important aspect of their construction is the frictional characteristics exhibited by the apertured top layer 20. As mentioned above, the apertured top layer 20 is preferably formed of a nonabsorbent, thermally non-conductive thermoplastic material such as an ethylene-vinyl acetate copolymer whose vinyl acetate content can be varied to alter the coefficient of friction of such material. In the presently preferred embodiment, the vinyl acetate content of the apertured top layer 20 is maintained in the range of about 3% to 40% by weight, and is selected to provide a coefficient of friction such that the magnitude of the frictional engagement between the apertured top layer 20 and the sock 14 is maintained less than the magnitude of the frictional engagement between the sock 14 and foot 16. A principal objective of this invention is to induce movement of the foot 16 and sock 14 together as a unit along the apertured top layer 20 within the interior of the shoe 10, in response to the application of shear forces to the foot 16, instead of allowing the sock 14 to stick to the apertured top layer 20 so that the foot 16 can move relative to the sock 14. Movement of the foot 16 within the sock 14 should be avoided because it induces the formation of blisters and other damage to the foot 16. By controlling the frictional characteristics of the apertured top layer 20, the foot 16 and sock 14 move together relative to the apertured top layer 20 so that the sock 14 protects the foot 16.

Importantly, tests have shown that the coefficient of friction of the apertured top layer 20 of this invention remains substantially constant whether the apertured top layer 20 is wet or dry. This is true over the entire range of different coefficients of friction which can be provided by the apertured top layer 20 as the vinyl acetate content of the ethylene-vinyl acetate copolymer is varied. As a result, the magnitude of the frictional engagement between the apertured top layer 20 and sock 14 remains essentially the same when the foot sweats and the sock 14 becomes moist after the wearer begins an activity, whereas the magnitude of the frictional engagement between the sock 14 and foot 16 increases as the sock 14 becomes wet. Because the frictional engagement between the top layer 20 and sock 14 remains substantially constant, it is always maintained less than the frictional engagement between the sock 14 and foot 16. The foot 16 is therefore protected from sliding motion along the sock 14, and the incidence of blisters and other problems caused by rubbing of the foot 16 along the sock 14 are substantially eliminated.

While the overall objective of the insole of each of the embodiments of this invention is to substantially prevent movement of the foot 16 with respect to sock 14, it is nevertheless desirable to vary the coefficient of friction of the apertured top layer 20 of insoles 18, 34, 50, 54, 60 and 70 and thus vary the magnitude of the frictional engagement between the apertured top layer 20 and sock 14. For example, activities such as basketball, racquetball, squash, aerobic exercises and the like are typically placed on surfaces such as lacquered hardwood floors which permit little or no movement of the outersole of the article of footwear with respect to such surfaces. The same is true of the various forms of artificial playing surfaces. Because of the relatively high coefficient of friction of such surfaces, and the design of the outersole of the articles of footwear intended for use on such surfaces, relatively high shear forces are transmitted through the article of footwear to the foot and sock while playing activities on these surfaces. In order to avoid the application of undue shear forces to the foot, it is preferable to allow at least some sliding motion of the foot and sock, as a unit, with respect to the apertured top layer 20 of each of the insoles described above. This is accomplished by lowering the vinyl acetate content of the apertured top layer 20, e.g., on the order of about 3–6% by weight, for example, so that the coefficient of friction of the apertured top layer 20 is reduced to a level on the order of about 0.4. This permits some sliding motion of the foot and sock along the apertured top layer in response to the application of shear forces thereof. But such coefficient of friction also provides for a degree of slip resistance between the apertured top layer and sock so as to avoid unrestricted movement of the foot and sock within the article of footwear and therefore prevent violent contact of the foot with the toe or other areas of the shoe which can cause "turf toe" and other foot problems.

Many other types of activities do not result in the application of high shear forces to the foot, and considerations such as comfort, "feel" and control of the shoe are paramount. For example, activities such as the play of tennis on clay courts or soccer on grass results in the shoe readily sliding with respect to the playing surface. Running, walking, hiking and similar activities also do not result in the application of comparatively high shear forces to the foot. In order to accommodate these types of activities, the coefficient of friction of the apertured top layer 20 of an of the insoles herein is increased to a level on the order of about 0.45 to 0.50 by increasing the vinyl acetate content of the apertured top layer 20 to a level on the order of about 12% or higher. This, in turn, increases the magnitude of the frictional engagement between the insole and sock. Any of the insoles of this invention described above having a higher coefficient of friction permits comparatively lesser sliding movement of the sock therealong to provide an enhanced feeling of control of the article of footwear, but, nevertheless, the magnitude of the frictional engagement between the sock and insole is maintained less than that between the sock and foot.

While the invention has been described with reference to a preferred embodiment, it will be understood by those skilled in the art that various changes may be made and equivalents may be substituted for elements thereof without departing from the scope of the invention. In addition, many modifications can be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. An insole for an article of footwear, comprising:

a first layer formed of a slip-resistant, non-absorbent and thermally non-conductive thermoplastic material, said first layer being formed with a plurality of apertures having wall sections therebetween, said wall sections of said first layer having an inner surface and an outer, exposed surface which contacts the foot of a wearer of the article of footwear;

a second layer affixed to said wall sections of said first layer said second layer being formed of a non-woven material consisting of a mixture of moisture-wicking fibers and moisture-absorbent fibers, said second layer having a basis weight in the range of about 2 ounces per square yard to about 5 ounces per square yard and a tear strength in the range of about 35 pounds to about 100 pounds in the machine direction and in the range of about 25 pounds to about 60 pounds in the cross direction, said non-woven material of said second layer being effective to substantially prevent movement of said wall sections of said first layer relative to one another under the application of a shear force to said first layer as a result of front-to-back, side-to-side and/or rotational movement of the foot of the wearer of the article of footwear which contacts said first layer.

2. The insole of claim 1 in which said moisture-wicking fibers are acrylic fibers.

3. The insole of claim 1 in which said moisture-absorbent fibers are cellulosic fibers.

4. The insole of claim 1 in which said first layer is formed of an ethylene-vinyl acetate copolymer.

5. The insole of claim 4 in which said ethylene-vinyl acetate copolymer has a vinyl acetate content in the range of about 3% to 40% by weight.

6. The insole of claim 1 in which said first layer has in the range of about 7 to 107 apertures per square centimeter.

7. The insole of claim 1 in which said apertures are square in shape, said apertures forming spaced columns of first wall sections and spaced rows of second wall sections which intersect said first wall sections, said first layer having in the range of about 8 to 9 columns of first wall sections per lineal centimeter and in the range of about 8 to 9 rows of second wall sections per lineal centimeter.

8. The insole of claim 1 in which said wall sections of said first layer have a height dimension and a width dimension each in the range of about 0.38 to 3.8 millimeters.

9. The insole of claim 1 in which said moisture-wicking fibers and said moisture- absorbent fibers each have a length in the range of about 1.9 to 7.6 centimeters.

10. The insole of claim 1 in which said moisture-wicking fibers and said moisture-absorbent fibers each have a substantially round cross section.

11. The insole of claim 1 in which said moisture-wicking fibers and said moisture-absorbent fibers are crimped.

12. The insole of claim 1 in which said second layer has a mixture in the range of about 25% to less than 50% moisture-wicking fibers, and 75% to greater than 50% moisture-absorbent fibers, by weight.

13. The insole of claim 1 in which said second layer has a mixture in the range of about 30% to 40% moisture-wicking fibers, and 60% to 70% moisture-absorbent fibers, by weight.

14. The insole of claim 1 in which said mixture of moisture-wicking fibers and moisture-absorbent fibers forming said second layer has a basis weight in the range of about 2 to 5 ounces per square yard.

15. The insole of claim 1 in which said moisture-wicking fibers contain an antimicrobial agent.

16. The insole of claim 1 in which said moisture-wicking fibers and said moisture-absorbent fibers each have a denier per filament in the range of about 0.75 to 3.0.

17. The insole of claim 1 further including a third layer affixed to said second layer, said third layer being formed of a cushioning material.

18. The insole of claim 17 in which said cushioning material forming said third layer is selected from the group consisting of latex foam, cross-linked polyurethane foam, ethylene-vinyl acetate foam, ethylene-vinyl acetate enhanced cross-linked polyurethane foam, sponge rubber foam and vinyl sponge foam.

19. An insole for an article of footwear, comprising:

a first layer formed of a slip-resistant, non-absorbent and thermally non-conductive thermoplastic material, said first layer being formed with a plurality of apertures having wall sections therebetween, said first layer having an inner surface and an outer exposed surface which contacts the foot of the wearer of the article of footwear;

a second layer affixed to said wall sections along the inner surface of said first layer, said second layer consisting of a non-woven material having a basis weight in the range of about 2 ounces per square yard to about 5 ounces per square yard and a tear strength in the range of about 35 pounds to about 100 pounds in the machine direction and in the range of about 25 pounds to about 60 pounds in the cross direction said non-woven material of said second layer being effective to substantially prevent movement of said wall sections of said first layer relative to one another under the application of a shear force to said first layer as a result of front-to-back, side-to-side and/or rotational movement of the foot of the wearer of the article of footwear which contacts said first layer.

20. The insole of claim 19 in which said first layer is formed of an ethylene-vinyl acetate copolymer.

21. The insole of claim 20 in which said ethylene-vinyl acetate copolymer has a vinyl acetate content in the range of about 3% to 40% by weight.

22. The insole of claim 19 in which said first layer has in the range of about 7 to 107 apertures per square centimeter.

23. The insole of claim 19 in which said apertures are square in shape, said apertures forming spaced columns of first wall sections and spaced rows of second wall sections which intersect said first wall sections, said first layer having in the range of about 8 to 9 columns of first wall sections per lineal centimeter and in the range of about 8 to 9 rows of second wall sections per lineal centimeter.

24. The insole of claim 19 further including a cushioning layer affixed to said second layer opposite said first layer.

25. The insole of claim 19 in which said cushioning layer is formed of a material chosen from the group consisting of latex foam, cross-linked polyurethane foam, ethylene-vinyl acetate foam, ethylene-vinyl acetate enhanced cross-linked polyurethane foam, sponge rubber foam and vinyl sponge foam.

* * * * *